US008097809B2

(12) United States Patent
Galletti et al.

(10) Patent No.: US 8,097,809 B2
(45) Date of Patent: Jan. 17, 2012

(54) LOW-SMOKE SELF-EXTINGUISHING CABLE AND FLAME-RETARDANT COMPOSITION COMPRISING NATURAL MAGNESIUM HYDROXIDE

(75) Inventors: Franco Galletti, Milan (IT); Gabriele Perego, Milan (IT); Armando Michele Ferrari, Milan (IT); Gavin Holden, Milan (IT)

(73) Assignee: Prysmian Cavi e Sistemi Energia S.R.L., Milan (IT)

( * ) Notice: Subject to any disclaimer, the term of this patent is extended or adjusted under 35 U.S.C. 154(b) by 568 days.

(21) Appl. No.: 11/992,923

(22) PCT Filed: Oct. 27, 2005

(86) PCT No.: PCT/IB2005/003208

§ 371 (c)(1),
(2), (4) Date: Mar. 23, 2009

(87) PCT Pub. No.: WO2007/049090

PCT Pub. Date: May 3, 2007

(65) Prior Publication Data

US 2009/0314514 A1 Dec. 24, 2009

(51) Int. Cl.
*H01B 7/00* (2006.01)

(52) U.S. Cl. ..... 174/110 R; 174/120 R; 174/121 R; 174/121 A

(58) Field of Classification Search ..... 174/110 R, 174/113 R, 120 R, 120 SC; 524/436, 523
See application file for complete search history.

(56) References Cited

U.S. PATENT DOCUMENTS

| | | | | |
|---|---|---|---|---|
| 4,130,535 | A | 12/1978 | Coran et al. | |
| 4,317,765 | A | 3/1982 | Gaylord | |
| 4,348,459 | A | 9/1982 | Drzal et al. | |
| RE31,518 | E | 2/1984 | Fischer | |
| 4,671,896 | A * | 6/1987 | Hasegawa et al. | 523/210 |
| 4,948,840 | A | 8/1990 | Berta | |
| 4,985,502 | A | 1/1991 | Izumi et al. | |
| 5,474,602 | A | 12/1995 | Brown et al. | |
| 5,696,615 | A * | 12/1997 | Alexander | 398/92 |
| 5,726,231 | A | 3/1998 | Namiki et al. | |
| 6,025,424 | A | 2/2000 | Katsuki et al. | |
| 6,043,312 | A * | 3/2000 | Fagher et al. | 524/523 |
| 6,255,399 | B1 * | 7/2001 | Castellani et al. | 525/232 |
| 6,303,681 | B1 * | 10/2001 | Furukawa et al. | 524/436 |

(Continued)

FOREIGN PATENT DOCUMENTS

EP 0 542 253 B1 5/1993

(Continued)

OTHER PUBLICATIONS

Yasuda, "Fine Magnesium Hydroxide Powder, Its Manufacturing Method and Fire-Resistant Resin Composition", Patent Abstracts of Japan of JP Publication No. 2002/167219, Publication Date Jun. 11, 2002.

(Continued)

*Primary Examiner* — William Mayo, III
(74) *Attorney, Agent, or Firm* — Finnegan, Henderson, Farabow, Garrett & Dunner, L.L.P.

(57) ABSTRACT

A cable having a conductor and a flame-retardant coating having (a) a polymer matrix; and (b) natural magnesium hydroxide particles having an average size ($d_{50}$) of 0.5 μm to 5.0 μm and an average pore diameter less than or equal to 0.35 μm.

17 Claims, 1 Drawing Sheet

U.S. PATENT DOCUMENTS

| | | | | |
|---|---|---|---|---|
| 6,552,112 | B1 * | 4/2003 | Redondo et al. | 524/436 |
| 6,555,605 | B1 * | 4/2003 | Casiraghi | 524/126 |
| 6,676,920 | B1 | 1/2004 | Oishi et al. | |
| 6,849,217 | B1 | 2/2005 | Peruzzotti et al. | |
| 2005/0222314 | A1 | 10/2005 | Credali et al. | |

FOREIGN PATENT DOCUMENTS

| | | | |
|---|---|---|---|
| EP | 0 618 259 | B1 | 10/1994 |
| EP | 1 559 736 | A1 | 8/2005 |
| JP | 62-58774 | B2 | 12/1987 |
| JP | 2002-167219 | | 6/2002 |
| RU | 2 125 581 | C1 | 1/1999 |
| RU | 2 237 078 | C2 | 9/2003 |
| RU | 37872 | U1 | 5/2004 |
| WO | WO 99/05688 | A1 | 2/1999 |

OTHER PUBLICATIONS

English language translation of the Decision on Grant issued in the corresponding Russian Application No. 2008116710.

* cited by examiner

LOW-SMOKE SELF-EXTINGUISHING CABLE AND FLAME-RETARDANT COMPOSITION COMPRISING NATURAL MAGNESIUM HYDROXIDE

CROSS REFERENCE TO RELATED APPLICATION

This application is a national phase application based on PCT/IB2005/003208, filed Oct. 27, 2005, the content of which is incorporated herein by reference.

BACKGROUND OF THE INVENTION

1. Field of the Invention

The present invention relates to cables, in particular for low-voltage electrical energy distribution or for telecommunications, these cables having low-smoke self-extinguishing properties, and to the flame-retardant compositions used therein.

2. Description of the Related Art

Self-extinguishing cables can be produced having a flame-retardant coating made from a polymer composition to which fire-resistant properties have been given by adding a suitable additive. Polyolefin-based compositions based, for example, on polyethylene or ethylene/vinyl acetate copolymers, containing an organic halide combined with antimony trioxide as flame-retardant additive can, for example, be used for this purpose. However, halogenated flame-retardant additives have many drawbacks since they partially decompose during processing of the polymer, giving rise to halogenated gases that are toxic to workers and corrode metal parts of the polymer processing equipment. In addition, when they are placed directly in a flame, their combustion gives rise to large amounts of fumes containing toxic gases. Similar drawbacks are encountered when polyvinylchloride (PVC) supplemented with antimony trioxide is used as base polymer.

As reported, for example, by WO 99/05688, the production of self-extinguishing cables has been directed toward halogen-free compositions, using as flame-retardant filler inorganic oxides, preferably in hydrate or hydroxide form, in particular magnesium hydroxide or aluminium hydroxide.

Aluminium hydroxide starts to decompose at a relatively low temperature (about 190° C.), which can result in various drawbacks during extrusion of the polymer composition, with formation of bubbles and defects in the final product. Therefore, the use of aluminium hydroxide as flame retardant is generally limited to polymer materials which do not require high processing temperatures. In contrast, magnesium hydroxide has a decomposition temperature of about 340° C. and is characterized by greater heat stability and a high decomposition enthalpy. These properties make magnesium hydroxide particularly suitable as flame retardant filler in polymer compositions for coating cables, which require high extrusion temperatures and a small number of morphological defects.

In order to obtain an efficient flame-retardant effect, very large amounts of magnesium hydroxide must be added to the polymer material, generally about 120-250 parts by weight relative to 100 parts by weight of polymer material. Such high levels of magnesium hydroxide as filler lead to an increase of the polymer material viscosity and, as a consequence, to the lengthening of the manufacturing time. In addition, said viscosity increasing brings about a rising of the polymer material temperature during extrusion which, in turn, can cause the thermal degradation of the magnesium hydroxide contained therein.

High levels of magnesium hydroxide can also lead to a reduction in mechanical and elastic properties of the resulting polymer mixture, in particular as regards impact resistance, elongation and stress at break.

The reduction in mechanical and elastic properties of the resulting mixture is attributed to the low affinity of magnesium hydroxide with the polymer material.

Said affinity is connected to the magnesium hydroxide crystallinity and morphology, in term of geometric form and dimensional distribution of the magnesium hydroxide particles, beyond to the polarity of the surface and, in the case of natural magnesium hydroxide, to the impurities content, for example iron and manganese.

Therefore, research efforts have been directed towards modifying properties of magnesium hydroxide to improve its compatibility with the polymer matrix and its degree of purity.

For example, U.S. Pat. No. 6,676,920 B1 relates to a synthetic magnesium hydroxide particles having a hexagonal crystal form and having a specific aspect ratio (H) which is relatively large as compared with conventional ones. The range of the aspect ratio (H) is determined in correlation with values of an average secondary particle diameter (A), in the range of 0.15 to 5 μm, and a BET specific surface area (B), from 1 to 150 $m^2/g$, of the magnesium hydroxide particles. The total content, as a metal content, of an iron compound content and a manganese compound content as impurities in the particles in the magnesium hydroxide particles is 0.01% by weight or less, preferably 0.005% by weight or less. The magnesium hydroxide particles are suitable for use as a flame retardant for synthetic resins.

The use of synthetic magnesium hydroxide as flame-retardant filler has a considerable impact on the cost of the finished product respect to the use of natural magnesium hydroxide obtained, for example, by grinding minerals such as brucite.

As from WO 99/05688, the magnesium hydroxide obtained by precipitation consists of flattened hexagonal crystallites that are substantially uniform both in size and morphology. In contrast, natural magnesium hydroxide has a highly irregular granular morphology in terms both of geometrical shape and of surface appearance.

Attempts have been made to improve the properties of natural magnesium hydroxide For example U.S. Pat. No. 5,474,602 describes improved fire retardant fillers for plastics material which consist of magnesium hydroxide particles of reduced average surface area. The particles are produced by contacting particles of a relatively high average surface area with an etching solution for a time sufficient to dissolve at least some of the particles and leave particles of reduced average surface area.

U.S. Pat. No. 6,025,424 relates to a flame retardant having heat deterioration resistance which is composed of magnesium hydroxide particles having (i) an average particle diameter of not more than 2 μm, (ii) a specific surface area, measured by a BET method, of not more than 20 $m^2/g$ and containing (iii) a total amount of an iron compound and a manganese compound of not more than 0.02% by weight in terms of metals.

SUMMARY OF THE INVENTION

The Applicant felt the need of manufacturing a self-extinguishing cable comprising natural magnesium hydroxide as flame-retardant filler having, endowed with improved mechanical properties with respect to the known cables containing natural magnesium hydroxide as flame-retardant filler, while maintaining the flame retardant characteristics.

An important parameter commonly used to define the particle size of a particulate filler is the so called "$d_{50}$". The $d_{50}$ is defined as the diameter (in microns) of the particles at which 50% by volume of the particles have a diameter greater than that figure and 50% by volume of the particles have a diameter less than that figure.

The Applicant perceived that besides the particle size ($d_{50}$) and the specific surface area (BET), taken alone or combined together, further morphological and physical characteristics of the natural magnesium hydroxide particles could play a role in the mechanical properties of a cable with a layer comprising such particles, and to the self-extinguishing characteristics thereof.

Two magnesium hydroxide samples may have the same $d_{50}$, but very different BET values. The comparison between BET values does not provide a complete information about morphology, crystallinity, dimension and distribution of the particles.

The Applicant perceived that the elastic and mechanical properties of a self-extinguishing cable compound could depend on the surface characteristics and on the shape (hereinafter also collectively referred to as "morphological characteristics") of the natural magnesium hydroxide particles as flame-retardant filler.

The Applicant perceived that a significant parameter of the morphological characteristics is the average pore diameter (4V/A), as will be discussed in further detail in the following.

According to a first aspect, the present invention relates to a cable with self-extinguishing properties, comprising a conductor and a flame-retardant coating, wherein said flame-retardant coating comprises:

(a) a polymeric matrix; and (b) natural magnesium hydroxide particles having an average particle size ($d_{50}$) of from 0.5 μm to 5.0 μm, and an average pore diameter (4V/A) less than or equal to 0.35 μM.

For the purpose of the present description and of the claims which follow, except where otherwise indicated, all numbers expressing amounts, quantities, percentages, and so forth, are to be understood as being modified in all instances by the term "about". Also, all ranges include any combination of the maximum and minimum points disclosed and include any intermediate ranges therein, which may or may not be specifically enumerated herein.

Preferably, the flame retardant coating of the cable of the invention can be a sheath, an insulating layer or an insulating sheath.

The average pore diameter (4V/A) can be measured by mercury porosimetry method and calculated by the Washburn equation (I) describing the capillary flow in porous materials: wherein:

$$D = \left(\frac{1}{P}\right) \cdot 4\gamma \cdot \cos\varphi \qquad \text{(I)}$$

D is the pore diameter,

P is the pressure applied to the mercury,

γ is the mercury surface tension, and

ϕ is the contact angle between the mercury and the sample.

This equation assumes the pores as cylindrical, thus where the pore volume ($V=d^2\ l/4$) is divided by the pore area ($A=rdl$), the pore diameter (d) is equal to 4V/A In a preferred embodiment the average pore diameter (4V/A) is less than or equal to 0.25 μm.

According to the present invention, by the term natural magnesium hydroxide it is meant magnesium hydroxide obtained by grinding minerals based on magnesium hydroxide, such as brucite and the like. Brucite is found in its pure form or, more often, in combination with other minerals such as calcite, aragonite, talc or magnesite, often in stratified form between silicate deposits, for instance in serpentine asbestos, in chlorite or in schists.

The mineral containing magnesium hydroxide can be ground according to the following technique. Advantageously, the mineral as obtained from the mine is first crushed, then ground, preferably repeatedly, each crushing/grinding step being followed by a sieving step.

The grinding can be effected under wet or dry conditions, for example by ball-milling, optionally in the presence of grinding coadjuvants, for example polyglycols or the like. Optionally the grinding is carried out at a temperature In a preferred embodiment of the present invention the average particle diameter ($d_{50}$) of the natural magnesium hydroxide is of from 1.5 to 3.5 μm. The $d_{50}$ is measured by, for example, particle's settling velocity in a liquid using Sedigraph 5100 (by Micromeritics).

In a preferred embodiment of the present invention the specific surface area of the natural magnesium hydroxide, measured by a BET method, is of from 1 to 20 $m^2/g$, preferably from 5 to 15 $m^2/g$.

As BET method is intended a method developed by Bruner, Emmett, and Teller for measuring surface area by using nitrogen adsorption condensation in pores at liquid nitrogen temperature. The BET specific surface area is measured using a flowing gas method which involves the continuous flow of an adsorptive and inert gas mixture over the sample at atmospheric pressure, using, for example, FlowSorb II 2300 (by Micromeritics).

Preferably, the magnesium hydroxide according to the invention has a ratio $BET/d_{50}$ equal to or greater than 3.5, more preferably of from 4 to 6.

The natural magnesium hydroxide of the invention can contain impurities derived from salts, oxides and/or hydroxides of other metals, for example Fe, Mn, Ca, Si, and V. Amount and nature of the impurities can vary depending on the source of the starting mineral. The degree of purity is generally between 80 and 98% by weight. As regards water-soluble ionic-type impurities, their content can be determined indirectly by measuring electrical conductivity of an aqueous extract obtained by placing magnesium hydroxide in contact with a suitable amount of water for a predetermined period of time at a predetermined temperature. A more detailed description of this measurement, based on ISO method 787, is given hereinbelow. According to this method, electrical conductivity of the aqueous extract obtained from natural magnesium hydroxide is generally between 100 and 500 μS/cm, preferably between 120 and 350 μS/cm.

The natural magnesium hydroxide according to the present invention can be used as such or in the form of particles whose surface has been treated with at least one saturated or unsaturated fatty acid containing from 8 to 24 carbon atoms, or a metal salt thereof, such as, for example: oleic acid, palmitic acid, stearic acid, isostearic acid, lauric acid; magnesium or zinc stearate or oleate; and the like. To increase compatibility with the polymer matrix, natural magnesium hydroxide can also be surface-treated with suitable coupling agents, for example organic silanes or titanates such as vinyl-triethoxysilane, vinyltriacetylsilane, tetraisopropyltitanate, tetra-n-butyltitanate, and the like.

The amount of magnesium hydroxide which is suitable for imparting the desired flame-retardant properties can vary within a wide range, generally between 10 and 90% by weight, preferably between 30 and 70% by weight, based on the total of the particles and the polymeric matrix.

The natural magnesium hydroxide (b) can be used as the sole flame retardant filler of the coating of the invention or can be used in admixture with other flame retardant fillers. When the cable coating comprise a natural magnesium hydroxide having an average pore diameter (4V/A) higher than 0.35 μm together with the natural magnesium hydroxide of the invention, the amount of the natural magnesium hydroxide of the invention should preferably be more than the 50% of the total amount of flame retardant filler.

Illustrative examples of polymeric matrix according to the present invention, include polyethylene, polypropylene, ethylene-propylene copolymer, polymers and copolymers of $C_2$ to $C_8$ olefins (α-olefin) such as polybutene, poly(4-methylpentene-1) or the like, copolymers of these olefins and diene, ethylene-acrylate copolymer, polystyrene, ABS resin, AAS resin, AS resin, MBS resin, ethylene-vinyl acetate copolymer resin, vinyl acetate resin, phenoxy resin, polyacetal, polyamide, polyimide, polycarbonate, polysulfone, polyphenylene oxide, polyphenylene sulfide, polyethylene terephthalate, polybutylene terephthalate, methacrylic resin and the like.

Of the above, polyolefins and copolymers thereof having excellent flame retardant and heat deterioration prevention effects and mechanical strength retaining properties are preferred, as exemplified by polypropylene-based resins such as polypropylene homopolymers and ethylene-propylene copolymers; polyethylene-based resins such as high-density polyethylene, low-density polyethylene, straight-chain low-density polyethylene, ultra low-density polyethylene, EVA (ethylene-vinyl acetate resin), EEA (ethylene-ethyl acrylate resin), EBA (ethylene-butyl acrylate resin), EMA (ethylene-methyl acrylate copolymer resin), EAA (ethylene-acrylic acid copolymer resin) and ultra high molecular weight polyethylene; and polymers and copolymers of $C_2$ to $C_6$ olefins (α-olefin) such as polybutene and poly(4-methylpentene-1).

Optionally, thermosetting resins such as epoxy resin, phenol resin, melamine resin, unsaturated polyester resin, alkyd resin and urea resin and synthetic rubbers such as EPDM, butyl rubber, isoprene rubber, SBR, NIR, urethane rubber, polybutadiene rubber, acrylic rubber, silicone rubber, and NBR are also included.

Optionally, other fillers with flame-retardant properties are added to the natural magnesium hydroxide, for example aluminium hydroxide or alumina trihydrate ($Al_2O_3.3H_2O$). One or more inorganic oxides or salts such as CoO, $TiO_2$, $Sb_2O_3$, ZnO, $Fe_2O_3$, $CaCO_3$ or mixtures thereof can advantageously also be added in small amounts, generally less than 25% by weight.

With the aim of improving compatibility between magnesium hydroxide and polymer matrix, a coupling agent capable of increasing the interaction between the hydroxyl groups of magnesium hydroxide and the polyolefin chains may be added to the mixture. This coupling agent can be selected from those known in the art, for example: saturated silane compounds or silane compounds containing at least one ethylenic unsaturation; epoxides containing an ethylenic unsaturation; monocarboxylic acids or, preferably, dicarboxylic acids having at least one ethylenic unsaturation, or derivatives thereof, in particular anhydrides or esters.

Examples of silane compounds which are suitable for this purpose are: γ-methacryloxypropyl-trimethoxysilane, methyltriethoxysilane, methyltris (2-methoxyethoxy)silane, dimethyldiethoxysilane, vinyltris (2-methoxyethoxy)silane, vinyltrimethoxysilane, vinyl-triethoxysilane, octyltriethoxysilane, isobutyl-triethoxysilane, isobutyltrimethoxysilane and mixtures thereof.

Examples of epoxides containing an ethylenic unsaturation are: glycidyl acrylate, glycidyl methacrylate, monoglycidyl ester of itaconic acid, glycidyl ester of maleic acid, vinyl glycidyl ether, allyl glycidyl ether, or mixtures thereof.

Monocarboxylic or dicarboxylic acids, having at least one ethylenic unsaturation, or derivatives thereof, which can be used as coupling agents are, for example: maleic acid, maleic anhydride, fumaric acid, citraconic acid, itaconic acid, acrylic acid, methacrylic acid and the like, and anhydrides or esters derived therefrom, or mixtures thereof. Maleic anhydride is particularly preferred.

The coupling agents can be used as such or pre-grafted onto a polyolefin, for example polyethylene or copolymers of ethylene with an alpha-olefin, by means of a radicalic reaction (see for example patent EP-530,940). The amount of grafted coupling agent is generally between 0.05 and 5 parts by weight, preferably between 0.1 and 2 parts by weight, with respect to 100 parts by weight of polyolefin. Polyolefins grafted with maleic anhydride are available as commercial products known, for example, under the trademarks Fusabond® (Du Pont), Orevac® (Elf Atochem), Exxelor® (Exxon Chemical), Yparex® (DSM).

Alternatively, the coupling agents of carboxylic or epoxide type mentioned above (for example maleic anhydride) or the silanes with ethylenic unsaturation (for example vinyltrimethoxysilane) may be added to the mixture in combination with a radical initiator so as to graft the compatibilizing agent directly onto the polymer matrix. An organic peroxide such as tert-butyl perbenzoate, dicumyl peroxide, benzoyl peroxide, di-tert-butyl peroxide and the like can, for example, be used as initiator. This method is described, for example, in U.S. Pat. No. 4,317,765 or in Japanese patent application JP-62-58774.

The amount of coupling agent that can be added to the mixture can vary mainly depending on the type of coupling agent used and on the amount of magnesium hydroxide added, and is generally between 0.01 and 5%, preferably between 0.05 and 2%, by weight relative to the total weight of the base polymer mixture.

Other conventional components such as antioxidants, processing coadjuvants, lubricants, pigments, other fillers and the like can be added to the compositions of the present invention.

Conventional antioxidants which are suitable for this purpose are, for example: polymerized trimethyldihydroquinoline, 4,4'-thiobis(3-methyl-6-tert-butyl)phenol; pentaerythritol tetrakis[3-(3,5-di-tert-butyl-4-hydroxyphenyl) propionate], 2,2'-thio-diethylene-bis-[3-(3,5-di-tert-butyl-4-hydroxy-phenyl)propionate] and the like, or mixtures thereof.

Other fillers which may be used in the present invention include, for example, glass particles, glass fibres, calcined kaolin, talc and the like, or mixtures thereof. Processing coadjuvants usually added to the polymer base are, for example, calcium stearate, zinc stearate, stearic acid, paraffin wax, silicone rubbers and the like, or mixtures thereof.

The flame-retardant compositions according to the present invention can be prepared by mixing the polymer matrix components and the additives according to methods known in the art. The mixing can be carried out, for example, using an internal mixer of the type with tangential rotors (Banbury) or with interpenetrating rotors, or alternatively in continuous mixers such as those of the type Ko-Kneader (Buss), or of the type co-rotating or counter-rotating twin-screw. The flame-retardant compositions according to the present invention are preferably used in non-crosslinked form, to obtain a coating with thermoplastic properties and thus recyclable.

It is also possible to carry out a partial cross-linking of the polymer matrix according to methods known in the art, in particular by dynamic crosslinking, i.e. by adding a suitable radical initiator to the mixture during processing, for example an organic peroxide, optionally in the presence of a crosslinking co-agent such as, for example, 1,2-polybutadiene, triallylcyanurate or triallyl-isocyanurate. Dynamic crosslinking techniques are described, for example, in U.S.-Re. 31,518, U.S. Pat. No. 4,130,535, U.S. Pat. No. 4,348,459, U.S. Pat. No. 4,948,840, U.S. Pat. No. 4,985,502, EP-618,259. The mixture is processed at the vulcanization temperature specific to the radical initiator used, using a conventional mixer chosen, for example, from those mentioned above. At the end of the dynamic crosslinking, a partially crosslinked material is obtained in which thermoplastic properties and thus processability are retained, since a crosslinked phase is formed consisting of ethylene/alpha-olefin or ethylene/alpha-olefin/diene copolymer, which is dispersed in a thermoplastic phase consisting of non-crosslinked polypropylene. A person skilled in the art will be able to dose the radical initiator and the optional crosslinking co-agent suitably depending both on the specific conditions under which the dynamic crosslinking is carried out, and on the properties desired for the final product, in particular as regards the crosslinking degree.

As an alternative to organic peroxides, dynamic crosslinking can be carried out in the presence of non-peroxidic radical initiators, such as alkyl derivatives of 1,2-diphenylethane (see for example patent EP-542,253).

The polymer mixtures, optionally partially cross-linked as described above, can then be used to coat the conductor directly, or to make an outer sheath on the conductor previously coated with an insulating layer. This step can be carried out, for example, by extrusion. When two layers are present, the extrusion can be carried out in two separate stages, extruding the inner layer onto the conductor in a first run and the outer layer onto this inner layer in a second run. Advantageously, the coating process can be carried out in a single run, for example by means of a "tandem" method, in which two separate extruders arranged in series are used, or alternatively by co-extrusion using a single extrusion head.

In a second aspect, the present invention relates to a flame-retardant composition comprising:

(a) a polymeric matrix; and (b) natural magnesium hydroxide particles having an average particle size ($d_{50}$) of from 0.5 μm to 5.0 μm, and an average pore diameter (4V/A) less than or equal to 0.35 μm.

BRIEF DESCRIPTION OF THE DRAWINGS

The invention will be further illustrated hereinafter with reference to the following examples and figures wherein FIG. 1 schematically illustrates a cable according to the invention.

DETAILED DESCRIPTION OF THE INVENTION

Figure 1:
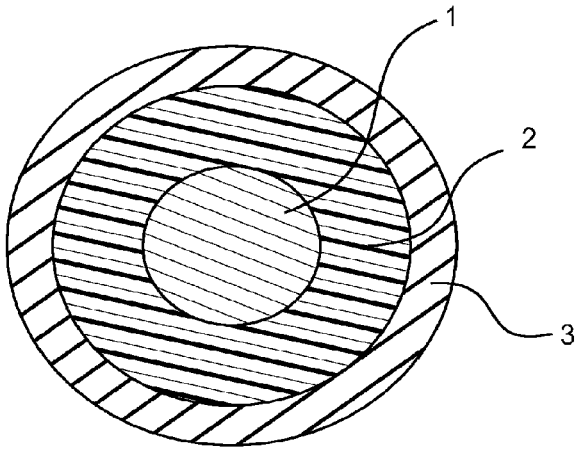

FIG. 1 shows, in a schematic form, the cross-section of a low-voltage electrical cable of unipolar type according to one embodiment of the present invention, this cable comprising a conductor (1), an inner layer (2) acting as electrical insulation and an outer layer (3) acting as a protective sheath with flame-retardant properties, consisting of the composition according to the present invention.

The term "low voltage" is understood generally to refer to a voltage of less than 2 kV, preferably less than 1 kV.

The inner layer (2) may consist of a halogen-free, crosslinked or non-crosslinked polymer matrix with electrically insulating properties which is known in the art, selected, e.g., from: polyolefins (homopolymers or copolymers of different olefins), olefin/ethylenically unsaturated ester copolymers, polyesters, polyethers, polyether/polyester copolymers, and mixtures thereof. Examples of such polymers are: polyethylene (PE), in particular linear low density PE (LLDPE); polypropylene (PP); propylene/ethylene thermoplastic copolymers; ethylene/propylene rubbers (EPR) or ethylene/propylene/diene rubbers (EPDM); natural rubbers; butyl rubbers; ethylene/vinylacetate (EVA) copolymers; ethylene/methylacrylate (EMA) copolymers; ethylene/ethylacrylate (EEA) copolymers; ethylene/butylacrylate (EBA) copolymers; ethylene/alpha-olefin copolymers, and the like. It is also possible to use the same polymer base for the inner layer (2) as well as for the outer layer (3), namely the mixture as defined above.

Alternatively, a self-extinguishing cable according to the present invention may comprise a conductor coated directly with the flame-retardant composition described above, without interposing other insulating layers. In this way, the flame-retardant coating also acts as electrical insulator. A thin polymer layer acting as an anti-abrasive can then be externally added, optionally supplemented with a suitable pigment to colour the cable for identification purposes.

The following types of magnesium hydroxide were used as flame-retardant fillers:

TABLE 1

| Name | $d_{50}$ (μm) | BET ($g/cm^3$) | BET/$d_{50}$ |
|---|---|---|---|
| MH 1 | 2.26 | 11.25 | 4.97 |
| MH 2 | 2.56 | 11.86 | 4.63 |
| Hydrofy ® G-2.5 | 2.92 | 7.02 | 2.40 |
| Hydrofy ® G-1.5 | 4.38 | 5.42 | 1.24 |

MH 1 and 2 are magnesium hydroxide particles according to the invention obtained by crushing and grinding a brucite mineral.

Hydrofy ® G-2.5 and G-1.5 are natural magnesium hydroxide powders obtained by grinding brucite, marketed by Nuova Sima Srl.

The $d_{50}$ and BET vales were measured as reported above.

Mercury Porosimetry Tests.

For the present measurements, a mercury porosimeter Micromeritics® AutoPore IV 9500 Series was employed by applying various levels of pressure to a sample immersed in mercury.

Mercury porosimetry characterizes a material porosity by applying various levels of pressure to a sample immersed in mercury. The pressure required to intrude into the sample's pores is inversely proportional to the size of the pores. From the pressure versus intrusion data, the instrument generates volume and size distributions using the Washburn equation.

All of the porosimetry evaluations were effected under the same instrumental conditions. The data were measured for the four samples of natural magnesium hydroxide having $d_{50}$ (μm) values as reported in Table 1.

The porosimetry evaluations are given in the following Table 2, wherein:

Median pore diameter (Volume; $V_{50}$) is the median pore diameter calculated at the 50% of the total intrusion volume;

median pore diameter (Area; $A_{50}$) is the median pore diameter calculated at the 50% of the total pore area;

average pore diameter (4V/A) is calculated by the Washburn equation as described above.

TABLE 2

| | Median pore diameter $V_{50}$ (μm) | Median pore diameter $A_{50}$ (μm) | Average Pore diameter 4 V/A (μm) |
|---|---|---|---|
| MH 1 | 0.36 | 0.14 | 0.24 |
| MH 2 | 0.32 | 0.09 | 0.19 |
| Hydrofy G-2.5 | 0.76 | 0.29 | 0.45 |
| Hydrofy G-1.5 | 0.71 | 0.28 | 0.42 |

Preparation of Flame-Retardant Compositions.

Compositions each comprising one of the natural magnesium hydroxide of Table 2 were prepared in a closed Banbury mixer (volume of the mixing chamber: 1200 $cm^3$) with a volume filling of 90%. The mixing was carried out at a temperature of 170° C. for a total time of 5 min (rotor speed: 55 revolution/min). The viscosity of the resulting mixture was determined at 130° C. according to ASTM standard D-1646.

The compositions (in phr, i.e. parts by weight per 100 parts of polymer matrix) are set forth in Table 3.

TABLE 3

| Ingredients | Example 1 | Example 2 (*) | Example 3 | Example 4 (*) |
|---|---|---|---|---|
| MH 1 | 140.0 | — | 160.0 | — |
| Hydrofy ® G 1.5 | — | 140.0 | — | 160.0 |
| Clearflex ® CLBO | 10.0 | 10.0 | 10.0 | 10.0 |
| Fusabond ® MB226-D | 10.0 | 10.0 | 10.0 | 10.0 |
| Greenflex ® FF55 | | | | |
| Elvax ® 40 | — | — | 10.0 | 10.0 |
| Anox ® 20 | 0.8 | 0.8 | 0.8 | 0.8 |

TABLE 3-continued

| Ingredients | Example 1 | Example 2 (*) | Example 3 | Example 4 (*) |
|---|---|---|---|---|
| Zn-stearato | 1.5 | 1.5 | 2.0 | 2.0 |
| Total amount | 242.3 | 242.3 | 262.8 | 262.8 |

(*) Examples 2 and 4 are comparative examples.

Clearflex ® CL BO (from the company Polimeri Europa) is LLDPE (a polymer base consisted of a mixture of two ethylene/vinyl acetate copolymers with linear low density polyethylene).

Fusabond ® MB-226 D (from the company DuPont) is maleic anhydride grafted LLDPE.

Greenflex ® FF55 (from the company Polimeri Europa) is an ethylene copolymer MFI = 0.75.

Elvax ® 40 L-03 is ethylene-vinyl acetate 40% vinyl acetate copolymer by DuPont.

Anox ® 20 (from the company Great Lakes Chemical Corporation) is an antioxidant (substituted tetrakismethylene-methane).

Mechanical Properties.

The flame-retardant compositions were subjected to mechanical tensile strength tests according to CEI standard 20-34, §5.1 on specimens taken from 1 mm-thick plates obtained by compression moulding at 180° C. and 200 bar after preheating for 5 min at the same temperature.

The same mechanical strength tests were carried out on cable specimens obtained by extruding the mixtures onto a single wire of red copper (section 1.5 $mm^2$; diameter: 1.4 mm) in an extruder with a cylinder having a 45 mm diameter and with a length equal to 25 diameters (final thickness of the insulating layer: 1.0 mm). Measurement of oxygen index (LOI).

The oxygen index was measured, according to ASTM standard D 2863, on plates obtained as described for the mechanical tests, but with a thickness of 3 mm.

Measurement of Flame-Resistance.

The cable specimens prepared as described above were subjected to the flame-resistance test according to CEI standard 332-1, which consists in subjecting a 60 cm long sample, placed vertically, to the direct action of a Bunsen flame applied for 1 min at an inclination of 45° relative to the sample.

The results of the mechanical strength and flame resistance tests of the compositions 1-4 as described above in Table 3 are given in Table 4.

TABLE 4

| TYPE OF TEST | | REQUESTED IEC 359 SHF1 | EX. 1 | EX. 2(*) | EX. 3 | EX. 4(*) |
|---|---|---|---|---|---|---|
| Tensile Strength (Mpa) | | 9.0 | 14.3 | 15.0 | 12.9 | 12.0 |
| Elongation at break (%) | | 125 | 180 | 110 | 165 | 80 |
| Modulus at 10% (Mpa) | | | 9.7 | 11.6 | 8.8 | 10.3 |
| Modulus at 20% (Mpa) | | | 11.1 | 13.4 | 10.3 | 12.0 |
| Modulus at 50% (Mpa) | | | 12.8 | 15.4 | 11.8 | 13.5 |
| AIR OVEN | T.S. (Mpa) | | 14.9 | 16.7 | 14.2 | 15.8 |
| Duration: 168 hours | E.B. (%) | | 140 | 90 | 120 | 70 |
| | Modulus at 10% (Mpa) | | 11.0 | 13.1 | 9.8 | 12.2 |
| | Modulus at 20% (Mpa) | | 12.9 | 15.3 | 11.6 | 14.6 |
| Temperature: +100° C. | Modulus at 50% (Mpa) | | 14.9 | 17.6 | 13.8 | 16.6 |
| Thickness | % variation orig. T.S. | (+/−30) | 4% | 11% | 10% | 32% |
| Sample | % variation orig. E.B. | (+/−30) | −22% | −18% | −27% | −13% |

TABLE 4-continued

| TYPE OF TEST | | REQUESTED IEC 359 SHF1 | EX. 1 | EX. 2(*) | EX. 3 | EX. 4(*) |
|---|---|---|---|---|---|---|
| Pressure test at high temp. | % residual thickness | >50 | 92.5 | 85 | 79.5 | 86 |
| Flame-retardant property | | | Yes | Yes | Yes | Yes |

(*)Examples 2 and 4 are comparative examples.

The results given in Table 4 clearly demonstrate that natural magnesium hydroxide of the Examples 1 and 3 used in combination with conventional polymer mixtures give better results in terms of mechanical and elastic properties, in particular as regards the elongation at break respect to the natural magnesium hydroxide of the Examples 2 and 4 (used in the same amount in the mixture).

As a comment to the results given in Table 2, it can be noticed that, according to the experiments carried out by the Applicant the use of natural magnesium hydroxide as flame-retardant filler in the compositions of the Examples 1 and 3 leads to a remarkable improvement in the mechanical and elastic properties of the material respect to the use of natural magnesium hydroxide as flame-retardant filler in the compositions of the Examples 2 and 4, as demonstrated by higher values of the elongation at break.

While the fire-resistance properties of Examples 1 and 3 are similar to those of Examples 2 and 4, the mechanical properties shown by Examples 1 and 3 are remarkably superior. Taking into account that the natural magnesium hydroxide amount in a polymeric matrix is often limited because of the risk of impairing the mechanical properties of the matrix, it is apparent that the natural magnesium hydroxide of the invention can be added into a polymer matrix in higher amounts while maintaining suitable mechanical properties and, in the same time, enhancing the self-extinguishing feature of the cable.

Taking into account the above the amount of the natural magnesium hydroxide used in the compositions 1 and 3 can be increased respect to the amount used in the compositions 2 and 4. In this situation the mechanical properties shown by the compositions 1 and 3 will reach those values shown by the compositions 2 and 4 but the flame retardant properties of the compositions 1 and 3 will be better to those of the compositions 2 and 4.

The mixtures of the invention, and the cables made therefrom, have excellent flame-retardant properties, which are close to those of mixtures and cables using synthetic magnesium hydroxide. This result is probably obtained by virtue of the choice of a natural magnesium hydroxide of the present invention that allows a better and more homogeneous dispersion of the magnesium hydroxide in the polymer bulk.

Therefore the natural magnesium hydroxide of the present invention allow to produce cables with better mechanical and elastic properties respect to the natural magnesium hydroxide of the prior art maintaining the same flame retardant properties. Alternatively the natural magnesium hydroxide of the present invention allow to produce cables with the same mechanical and elastic properties respect to the natural magnesium hydroxide of the prior art improving flame retardant properties.

A further evidence of the importance of the average porosity diameter (4 V/A) of the natural magnesium hydroxide of the invention is provided by the following tests.

The elongation at break (%) values provided by the compositions according to Examples 3 and 4 were evaluated and plotted together with the elongation at break (%) values of a composition wherein the flame retardant filler was composed by a mixture of 40% of MH 1 and 60% Hydrofy G-1.5, and a composition wherein the flame retardant filler was composed by a mixture of 60% of MH 1 and 40% Hydrofy G-1.5

Figure 2:
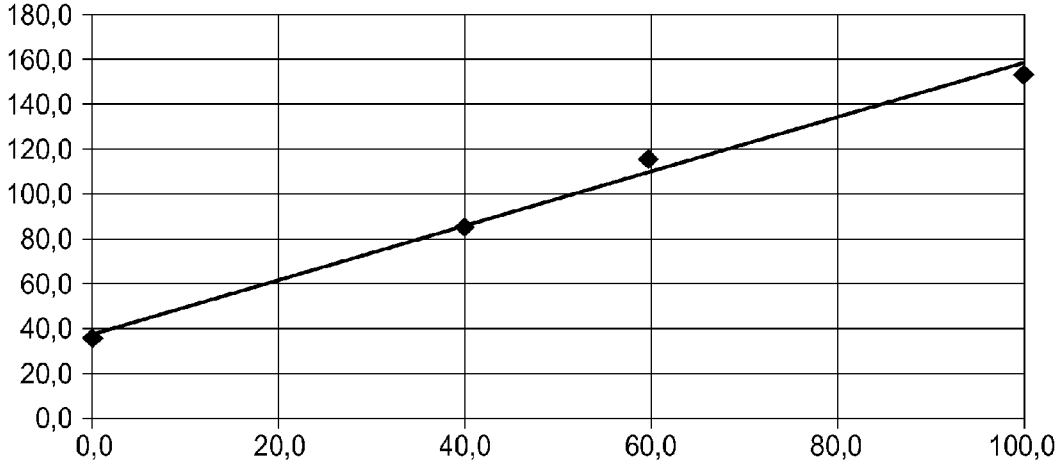
FIG. 2 shows the results of tests made on a natural magnesium hydroxide according to the invention and a comparative one.

FIG. 2 shows a chart wherein x-axis is the percentage of natural magnesium hydroxide according to the invention in a cable composition, and y-axis is the resulting elongation at break (%). By increasing the amount of the natural magnesium hydroxide having the average pore diameter (4 V/A) according to the invention, the elongation at break of the cable linearly increased.

Scanning Electron Microscopy (SEM) Analysis

Samples of MH 1 and Hydrofy G-1.5 were submitted to SEM analysis in order to observe the morphology and the geometrical shape of the particles thereof.

MH 1 is characterized by particles with a substantially spherical geometric form, whereas Hydrofy® G-1.5 particles are needle-shaped.

The improved mechanical performance obtained with the natural magnesium hydroxide particles according to the invention may be explained by considering the substantially spheroidal shape of the natural magnesium hydroxide particles according to the invention which does not alter significantly the polymer matrix nature, whereas the needle-shape structure of the conventional natural magnesium hydroxide powder is likely to generate multiple notches in the polymer matrix.

The invention claimed is:

1. A cable with self-extinguishing properties, comprising a conductor and a flame-retardant coating, wherein said flame-retardant coating comprises:

a) a polymer matrix; and b) natural magnesium hydroxide particles having an average particle size ($d_{50}$) of 0.5 μm to 5.0 μm, and an average pore diameter less than or equal to 0.35 μm.

2. The cable according to claim 1, wherein the average pore diameter is less than or equal to 0.25 μm.

3. The cable according to claim 1, wherein the magnesium hydroxide particles have a specific surface area measured by the BET method of 1 to 20 $m^2/g$.

4. The cable according to claim 3, wherein the magnesium hydroxide particles have a specific surface of 5 to 15 $m^2/g$.

5. The cable according to claim 1, wherein the magnesium hydroxide particles have an average particle size ($d_{50}$) of 1.5 to 3.5 μm.

6. The cable according to claim 1, wherein the magnesium hydroxide particles have a ratio ($BET/d_{50}$) equal to or greater than 3.5.

7. The cable according to claim 6, wherein the magnesium hydroxide particles have a ratio ($BET/d_{50}$) of 4 to 6.

8. The cable according to claim 1, wherein the natural magnesium hydroxide particles are present in an amount of 10 to 90% by weight, based on the total weight of a) and b).

9. The cable according to claim 8, wherein the amount of natural magnesium hydroxide particles are 30 to 70% by weight, based on the total weight of a) and b).

10. The cable according to claim 1, wherein when the coating further comprises natural magnesium hydroxide particles having an average pore diameter higher than 0.35 μm, the amount of the natural magnesium hydroxide particles (b) having an average pore diameter less than or equal to 0.35 μm is more than 50% of the total amount of flame retardant filler.

11. The cable according to claim 1, wherein the natural magnesium hydroxide particles are surface-treated.

12. The cable according to claim 11, wherein the natural magnesium hydroxide particles are surface-treated with at least one compound selected from the group of saturated or unsaturated fatty acids containing 8 to 24 carbon atoms, and metal salts thereof; organic silanes and titanates.

13. The cable according to claim 12, wherein natural magnesium hydroxide particles are surface-treated with at least one compound selected from the group of oleic acid, palmitic acid, stearic acid, isostearic acid, lauric acid; magnesium stearate, zinc stearate, magnesium oleate, zinc oleate; vinyltriethoxy-silane, vinyltriacetylsilane, tetraisopropyltitanate, and tetra-n-butyltitanate.

14. The cable according to claim 1, wherein the polymer matrix is selected from the group of polyethylene, polypropylene, ethylene-propylene copolymer, polymers and copolymers of $C_2$ to $C_8$ olefins, α-olefins, polybutene, poly (4-methylpentene-1) or the like, copolymers of these olefins and diene, ethylene-acrylate copolymer, polystyrene, ABS resin, AAS resin, AS resin, MBS resin, vinyl acetate resin, phenoxy resin, polyacetal, polyamide, polyimide, polycarbonate, polysulfone, polyphenylene oxide, polyphenylene sulfide, polyethylene terephthalate, polybutylene terephthalate, methacrylic resin, and mixture thereof.

15. The cable according to claim 1, wherein the polymer matrix is selected from the group of polymers and copolymers of $C_2$ to $C_4$ olefins, α-olefins, ethylene-vinyl acetate copolymer resin and ethylene-butyl acrylate copolymer resin.

16. A flame-retardant composition comprising:

a) a polymer matrix; and b) natural magnesium hydroxide particles having an average particle size ($d_{50}$) of 0.5 μm to 5.0 μm, and an average pore diameter less than or equal to 0.35 μm.

17. The composition according to claim 16, wherein the average pore diameter is less than or equal to 0.25 μm.

* * * * *